US005519807A

United States Patent [19]

Cellario et al.

[11] Patent Number: 5,519,807

[45] Date of Patent: May 21, 1996

[54] METHOD OF AND DEVICE FOR QUANTIZING EXCITATION GAINS IN SPEECH CODERS BASED ON ANALYSIS-SYNTHESIS TECHNIQUES

[75] Inventors: Luca Cellario; Daniele Sereno, both of Turin, Italy

[73] Assignee: SIP - Societa Italiana per l'Esercizio delle Telecomunicazioni p.a., Turin, Italy

[21] Appl. No.: 135,298

[22] Filed: Oct. 12, 1993

[30] Foreign Application Priority Data

Dec. 4, 1992 [IT] Italy ..... TO92A0982

[51] Int. Cl.[6] ..... G10L 9/00

[52] U.S. Cl. ..... 395/2.33; 395/2.29; 395/2.39

[58] Field of Search ..... 395/2.23, 2.24, 395/2.29–2.33, 2.35–2.37, 2.39, 2.38; 381/36–40

[56] References Cited

U.S. PATENT DOCUMENTS

| | | | |
|---|---|---|---|
| 4,704,730 | 11/1987 | Turner et al. | 395/2.24 |
| 4,803,730 | 2/1989 | Thomson | 395/2.16 |
| 4,945,565 | 7/1990 | Ozawa et al. | 395/2.32 |
| 4,945,567 | 7/1990 | Ozawa | 395/2.32 |
| 5,018,200 | 5/1991 | Ozawa | 395/2.31 |
| 5,265,167 | 11/1993 | Akamine et al. | 381/40 |
| 5,323,486 | 6/1994 | Taniguchi et al. | 395/2.29 |
| 5,369,724 | 11/1994 | Lim | 395/2.39 |

FOREIGN PATENT DOCUMENTS

| | | | |
|---|---|---|---|
| 0259950A1 | 3/1988 | European Pat. Off. | G10L 9/14 |
| 0396121A1 | 11/1990 | European Pat. Off. | G10L 9/14 |
| 0446817A2 | 9/1991 | European Pat. Off. | G10L 9/14 |

OTHER PUBLICATIONS

Kroon et al., "A Class of Analysis–By–Synthesis Predictive Coders for High Quality Speech Coding at Rates Between 4.8 and 16 Kbits/s," IEEE J. on Selected Areas in Communications, Feb. 1988, 6(2):353–63.

Gerson et al., "Vector Sum Excited Linear Prediction (VSELP) Speech Coding at 8 KBPS," '90 ICASSP, Apr. 3–6, 1990, pp. 461–464.

R. Drogo De Iacovo et al; "Embedded CELP Coding for Variable Bit–Rate Between 6.4 and 9.6 Kbit/s", CELT Technical rep. vol. XIX, No. 5, pp. 363–366.

*Primary Examiner*—Allen R. MacDonald
*Assistant Examiner*—Michael A. Sartori
*Attorney, Agent, or Firm*—Herbert Dubno

[57] ABSTRACT

An optimum excitation signal for each subframe is determined in a speech coder based on analysis-by-synthesis techniques and operating on frames of samples divided into a number of subframes. The excitation signal includes a shape contribution (innovation) and an amplitude contribution (gain) which are quantized separately. A circuit (IT) for gain quantization includes means (QU) for determining a gain index for each subframe; a comparison logic network (CFR) for detecting the maximum value taken by the gain index in the frame; and means for computing a normalized index for each subframe as a difference between the maximum index and the gain index relevant to that subframe. The coded signal includes the coded values of the maximum index and of the normalized indexes as information on the gain relevant to a frame.

15 Claims, 8 Drawing Sheets

METHOD OF AND DEVICE FOR QUANTIZING EXCITATION GAINS IN SPEECH CODERS BASED ON ANALYSIS-SYNTHESIS TECHNIQUES

SPECIFICATION

1. Field of the Invention

The present invention relates to speech coders, and, more particularly to a method of and a device for quantizing excitation gains in speech coders employing analysis-by-synthesis techniques.

2. Background of the Invention

In coders using analysis-by-synthesis techniques, the excitation signal for the synthesis filter simulating the speech production apparatus is chosen within a set of excitation signals so as to minimize a perceptually meaningful measure of distortion. These excitation signals can be for example regularly spaced pulses (regular pulse excitation coding or RPE), pulses spaced in a non uniform way (multipulse excitation coding or MPE), vectors or words made up of a certain number of samples (e.g. codebook excitation coding or CELP), etc.

Each excitation signal comprises a "shape" contribution (possible configurations of pulse positions in the case of regular pulse excitation or multipulse excitation, codebook vectors or words in case of CELP) and amplitude contribution (amplitude of the individual pulses in the case of regular pulse excitation or multipulse excitation, gain or scale factor for CELP). Information relevant to pulse signs can be included in one of the two contributions or in both or also kept separate, depending on the specific case. For a better understanding, hereinafter the two contributions will respectively be called "innovation" and "gain" and information on pulse signs will be comprised in the innovation, so that gain will be an absolute value. Information relevant to the two contributions are quantized separately during coding; during decoding, this information allows reconstructing the optimum excitation signal, which is filtered in a synthesis filter, corresponding to that utilized in the coder, in order to give the reconstructed signal.

The synthesis includes a short-term filter, which inserts features linked to the signal spectral envelope, and may include a long-term filter, which inserts features linked to the fine signal spectral structure.

Owing to the variability of speech signal, synthesis filter parameters must be updated periodically. The validity period, commonly called the frame, varies typically from a few milliseconds to a few tens of milliseconds (e.g. 2–30 ms). Each frame comprises therefore a number of samples which, when the sampling rate is equal to 8 kHz, varies from about ten to 1–2 hundreds. Except for short frames, it is not possible to use only one excitation signal for representing the whole frame, since this would require the use of relatively long pulse sequences, words or vectors, making too heavy or even unbearable the computational burden necessary to detect the optimum excitation. Each frame is then divided into a certain number of subframes and for each of them an optimum excitation is determined. Typical lengths for the subframes are 16–40 samples.

When the frame is divided into subframes, innovation in a subframe can be quantized independently from that of the contiguous subframes. The same method could be also adopted for gain quantization. This solution allows to keep into account at the transmitter the quantization effects both when searching for the optimum excitation during a subframe, and when computing initial conditions of the synthesis filter: an alignment between coder and decoder operations is obtained in this way and this makes recovery of quantization error easier. This solution is however scarcely efficient, since it does not exploit the correlation always existing between adjacent subframe gains and requires therefore a high number of coding bits for gain information. Only a lesser number of bits remains therefore available for coding other information. Considering that analysis-by-synthesis coders are mostly used in applications with a relatively low bit rate, the remaining bit availability can be insufficient to obtain a good quality of coded signal, cancelling the advantages deriving by the quantization at each subframe.

Methods carrying out an efficient quantization of excitation gain at the end of a frame, and not at each subframe, thus limiting the number of bits to be transmitted, are already known.

A first method is vector quantization, which is a particularly efficient technique for quantization of correlated or generally non-independent parameters. This method is however rarely adopted since vector quantization is very sensitive to transmission errors and its use would also imply the adoption of sophisticated error protection techniques, making the coder more complicated.

A second solution has been proposed in European patent application EP-A-0396121 in the name of CSELT, where the gain values of the subframes are normalized with respect to the maximum value or average value in the frame and both the normalized values and the maximum or average value are quantized. Obviously, the total number of bits is reduced, because the normalized value has a remarkably lower dynamics than the actual value; it is however necessary to have two quantization codebooks, one for maximum or average values, and the other for normalized values. Moreover, both with this technique and with the use of vector quantization, it is not possible to keep account of the quantization effects at the transmitter either during the optimum excitation search in the subframe or at the passage from a subframe to the next, since quantized values are not available yet.

OBJECT OF THE INVENTION

The object of the invention is to provide a method and a device for gain quantization allowing both availability at the coder of the quantized values relevant to each subframe, so as to keep account of quantization effects during optimum excitation search in a subframe and computation of initial conditions at the passage from a subframe to the next, and an efficient exploitation of correlations between adjacent subframe gains, with a consequent reduction of the coding bit number.

SUMMARY OF THE INVENTION

According to the invention, during coding in transmission, the amplitude contribution of the excitation signal is quantized at each subframe determining a gain index i(g); the maximum value i(gmax) in a frame of the gain index i(g) is determined; a normalized index i(gnor) relevant to each subframe is calculated as the difference between the maximum index i(gmax) and the particular subframe gain index i(g); and maximum index i(gmax) and the set of normalized indexes i(gnor) are coded and transmitted, in order to represent amplitude contributions relevant to a frame. During decoding, the gain index i(g) of each subframe is reconstructed starting from the maximum index in the frame i(gmax) and from the normalized index i(gnor) relevant to the subframe.

By this method, gains are quantized at each subframe, even if the relevant index is not transmitted, so that the quantized value is available and it can therefore be used, as in the case of scalar quantization at each subframe; moreover, information is transmitted in a differential (or normalized) form as to the indexes and not as to the quantized values, thus permitting a reduction of the quantity of information to be transmitted, as in EP-A-0 396 121, and the use of only one quantization codebook.

The invention also involves a device for carrying out the method, comprising, at the transmission side:

means for quantizing amplitude contribution values determined by a distortion minimization unit for each possible shape contribution, the quantization means supplying quantized amplitude values and gain indexes representing them;

a comparison logic network which receives from the quantization means, at each subframe, the index i(g) indicating the optimum amplitude contribution for that specific subframe which is arranged to recognize and to supply to index coding units at the end of a frame the maximum index i(gmax) among the received indexes;

means for temporarily storing gain indexes i(g) relevant to a frame; and means for computing a set of normalized indexes i(gnor), one per subframe, the computing means receiving the maximum index from comparison logic network and the stored indexes from storage means and computing the set of normalized indexes as the difference between the maximum index i(gmax) and each of the indexes i(g) stored in the storage means, the normalized indexes being supplied to index coding units;

and also comprising at the reception side, means for reconstructing a gain index i(g) for each subframe starting from the maximum index and from the normalized indexes, decoded in a decoding circuit, and for supplying this gain index i(g) as a reading address to a memory containing the set of quantized amplitude values.

The invention also concerns a method for coding speech signals employing analysis-by-synthesis techniques, where the excitation gains are quantized with the above mentioned quantization method, and a speech coder including the above mentioned device for quantizing excitation gains.

BRIEF DESCRIPTION OF THE DRAWING

The above and other objects, features, and advantages will become more readily apparent from the following description, reference being made to the accompanying drawing in which.

SPECIFIC DESCRIPTION

The description that follows will refer, by way of example, to a CELP coder, since therein the separation of excitation shape and amplitude contributions is immediate and the understanding of the invention is easier.

Figure 1:
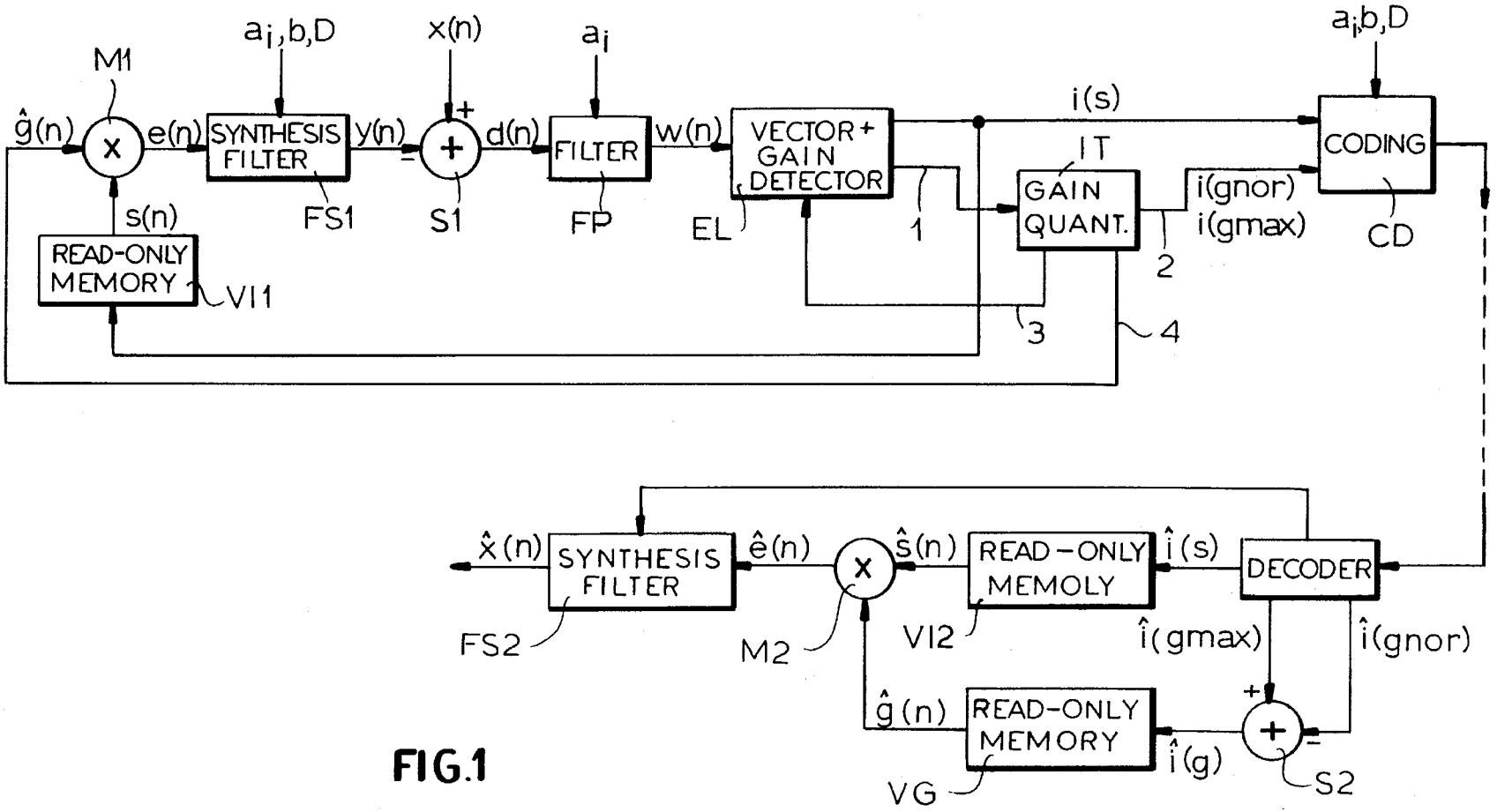
FIG. 1 is a schematic diagram of the analysis-by-synthesis loop of a coder using the invention.

Referring to FIG. 1, the transmitter of a CELP coding system can comprise:

a filtering system FS1 (synthesis filter) simulating the speech production apparatus and including in general the cascade of a long-term synthesis filter and a short-term synthesis filter which impose on an excitation signal respectively features linked to the fine signal spectral structure (in particular voiced sounds periodicity) and those linked to the signal spectral envelope. The parameters of this filter (linear prediction coefficients $a_i$, gain b and delay D of long-term analysis) are supplied by analysis circuits not represented.

A first read-only memory VI1, which contains the codebook of the innovation words vectors s(n).

A multiplier M1 during optimum excitation search, multiplies the words s(n) of the innovation codebook by the relevant gains g and gives an excitation signal e (n) to be filtered in synthesis filter FS1.

an adder S1, effects the comparison between an original signal x(n) and the filtered or reconstructed signal y(n) outcoming from synthesis filter FS1 and gives an error signal d(n) represented by the difference between the two signals.

A filter FP carries out spectral shaping or weighting of the error signal, to make less perceptible the differences between the original signal and reconstructed signal.

A processing unit EL carries out all the operations required to identify at each subframe the optimum innovation vector and the optimum gain (in absolute value and sign), i.e., the vector and gain minimizing the energy of the weighted error signal w(n) supplied by FP.

During this minimization, in the same way as in a conventional CELP coder, the possible innovation words will be tested in succession in each subframe and an optimum gain will be determined for each of them, At the end of each test cycle an optimum word and a relevant gain forming the excitation for that subframe, are then obtained. The minimization procedure is widely described in literature and it is not influenced by the present invention. Further details are therefore not necessary. A general description is nevertheless given in the article "A class of analysis-by-synthesis predictive coders for high quality speech coding at rates between 4,8 and 16 kb/s", by P. Kroon and E. F. Deprettere, IEEE Journal on Selected Areas on Communication, Vol. 6, N. 2 (February 1989) pages 353–364. The only particularities, according to the invention, are that the innovation codebook also contains a null word, which is used under certain conditions which will be described later and which is not taken into consideration during the optimum word search, and that the gains are quantized gains, so that the effects of quantization can be taken into account in determining the optimum word and in calculating the synthesis filter initial conditions at each subframe.

The information relevant to the chosen vector and gain, together with those relevant to the filter parameters, suitably quantized and binary coded in a coding circuit CD, make up the coded speech signal transmitted to the receiver. This information is normally represented by indexes or set of indexes allowing identifying the quantized value of each quantity in a relevant codebook of quantized values provided at the receiver.

For what concerns innovation, indexes i(s) of the words relevant to individual subframes are supplied to CD at the end of the frame, since only at this moment it can be checked whether the conditions exist for the choice of the null excitation word, as it will be explained further on. Gain quantization is carried out in a circuit IT, connected between the vector and gain detector block EL and coding circuit CD, to be described with reference to FIG. 3.

The receiver comprises: a decoder DC, performing operations complementary to those of the circuit CD; a first read-only memory VI2, a multiplier M2 and a synthesis filter FS2, identical to the transmitter units VI1, M1, FS1. A second read-only memory VG contains the quantized gain codebook. Information coming from the transmitter, suitably decoded in DC, allows selecting in decoder DC, allows selecting in read-only memories VI2 and VG, at each subframe, the word $\hat{s}$ (n) and the gain $\hat{g}$ (n) corresponding to those chosen during the coding stage, and updating the parameters of filter FS2. The reconstructed signal $\hat{x}$ (n), possibly converted into analog form is supplied to the utilization devices.

According to the present invention, quantized gains belong to a set of Ng values, where Ng is given by Ng=Nm+Nn−1, with Nm and Nn powers of 2. The reason why gain codebook size is expressed in this way will be made clear from the following description. Each of these values is associated with an index i(g) which is not transmitted but which is supplied to gain quantizer IT. Gain quantizer IT recognizes the maximum index i(gmax) among gain indexes i(g) of the frame and computes a set of normalized indexes i(gnor), one per subframe, according to relation i[gnor(k)]=i(gmax)−i[g (k)], where k is the generic subframe in the frame. At the end of frame the index i(gmax) and indexes i[gnor (k)] of the different subframes will be transmitted; these indexes will be given preset values when certain conditions occur, as explained further on. At the receiver, index $\hat{i}$(gmax) and indexes $\hat{i}$(gnor) reconstructed by DC are supplied to an adder S2, which re-creates indexes $\hat{i}$[g(k)] according to relation $\hat{i}$[g (k)]=$\hat{i}$(gmax)−$\hat{i}$[gnor (k)].

The conditions which result in importing a special value to i(gmax) and i(gnor) are:

too low a value of i(gmax), lower than Nn, in which case there is set i(gmax)=Nm; this check is carried out before determining indexes i(gnor); and too high a value of i(gnor), higher than Nn−1, in which case the null innovation word is transmitted (i.e. excitation is silenced), forcing also i(gnor) to Nn−1.

It can thus be seen that both i(gmax) and i(gnor) can assume only a limited number of values. Where Nm the possible number of values for i(gmax), the choice made for the minimum threshold of i(gmax) leads to the relationship given above for the size of the gain codebook. Thanks to the solution described, even in the case of an index i(g)<Nn, the normalized index i(gnor) can take the whole value dynamics and therefore always carry the maximum possible information which would otherwise be partly or totally wasted (as a matter of fact for i(gmax)=1, i(gnor) would be 0). In this way there is the advantage of having i(g) reach the value Nm+Nn−1, continuing however to utilize Nm values (and therefore $\log_2$Nm bit) for i(gmax).

As to the second condition, the normalized index i(gnor) has clearly a dynamic between 0 and a certain positive value. Taking into account the correlations which exist in general between the signals inside a frame, the maximum positive value (which indicates a very low gain in the concerned subframe) is limited to a suitable value, selected so that the probability of exceeding it is reasonably low. Should it be exceeded, the maximum admissible value for the index i(gnor) could be transmitted, and this corresponds to the amplification of the transmitted signal portion. According to the invention, it is however preferred to consider the subframe as silence and transmit the index i(s) corresponding to the null innovation word, since the distortion (subjective or objective) introduced by silencing a certain signal portion is lower than that due to an excessive amplification. Even if the index i(gnor) for this subframe does not bear any information, it is in any case preferred to transmit it with value Nn−1 because this reduces the distortion in case of errors introduced by the channel on the index i(s).

As stated earlier, the null word is not tested in the course of the optimum excitation search, and it is therefore convenient that it should be the first or the last word in the codebook contained in read-only memory VI1. It is obvious that the number of words must be sufficiently high to make negligible the performance loss inherent in the renunciation of one of them. This is already obtained, for example, by a codebook with 64 words, and this is in practice a small codebook enabling good quality processing.

Figure 2A:
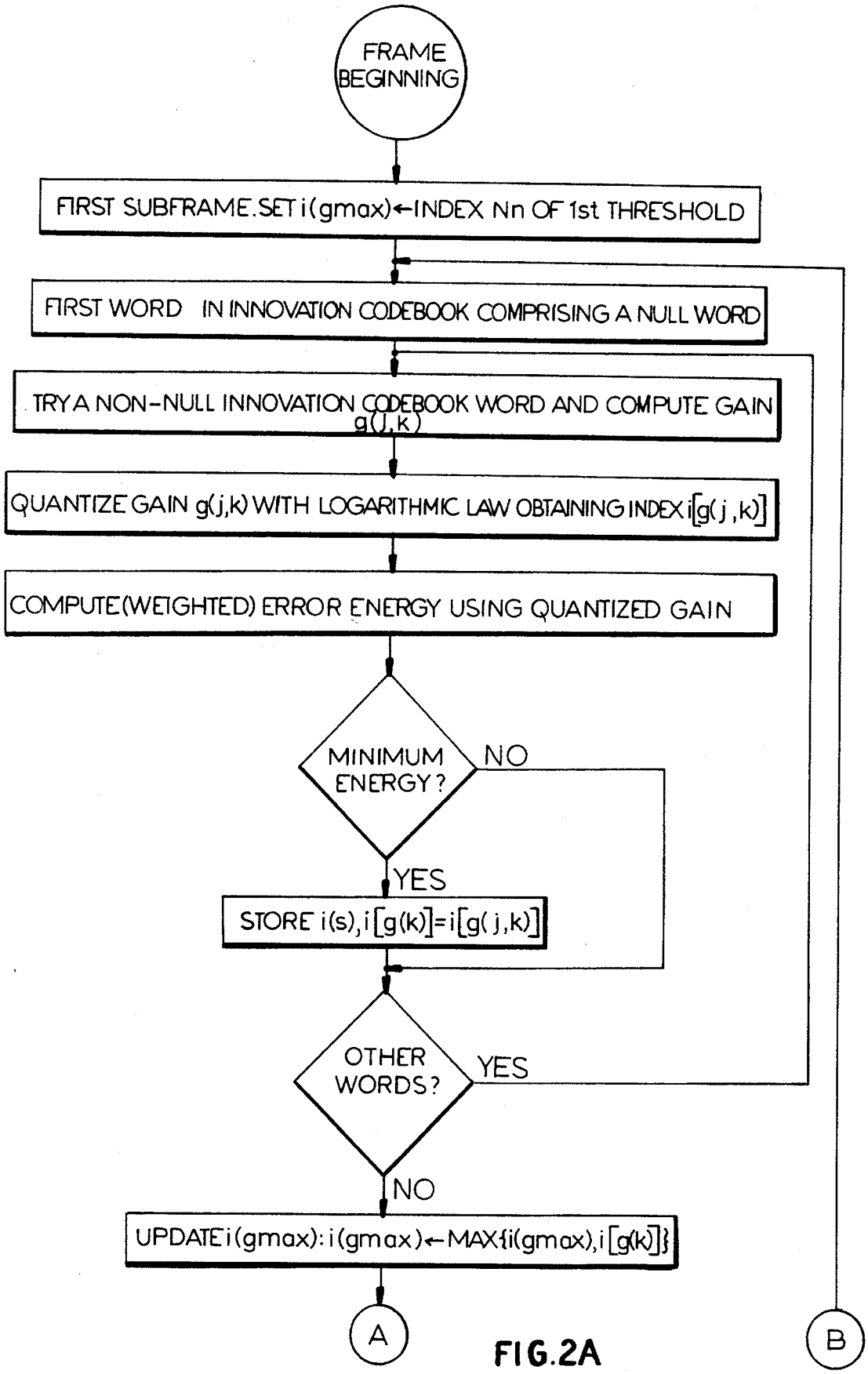
FIG. 2A and 2B together are a flow chart of the method according to the invention.
Figure 2B:
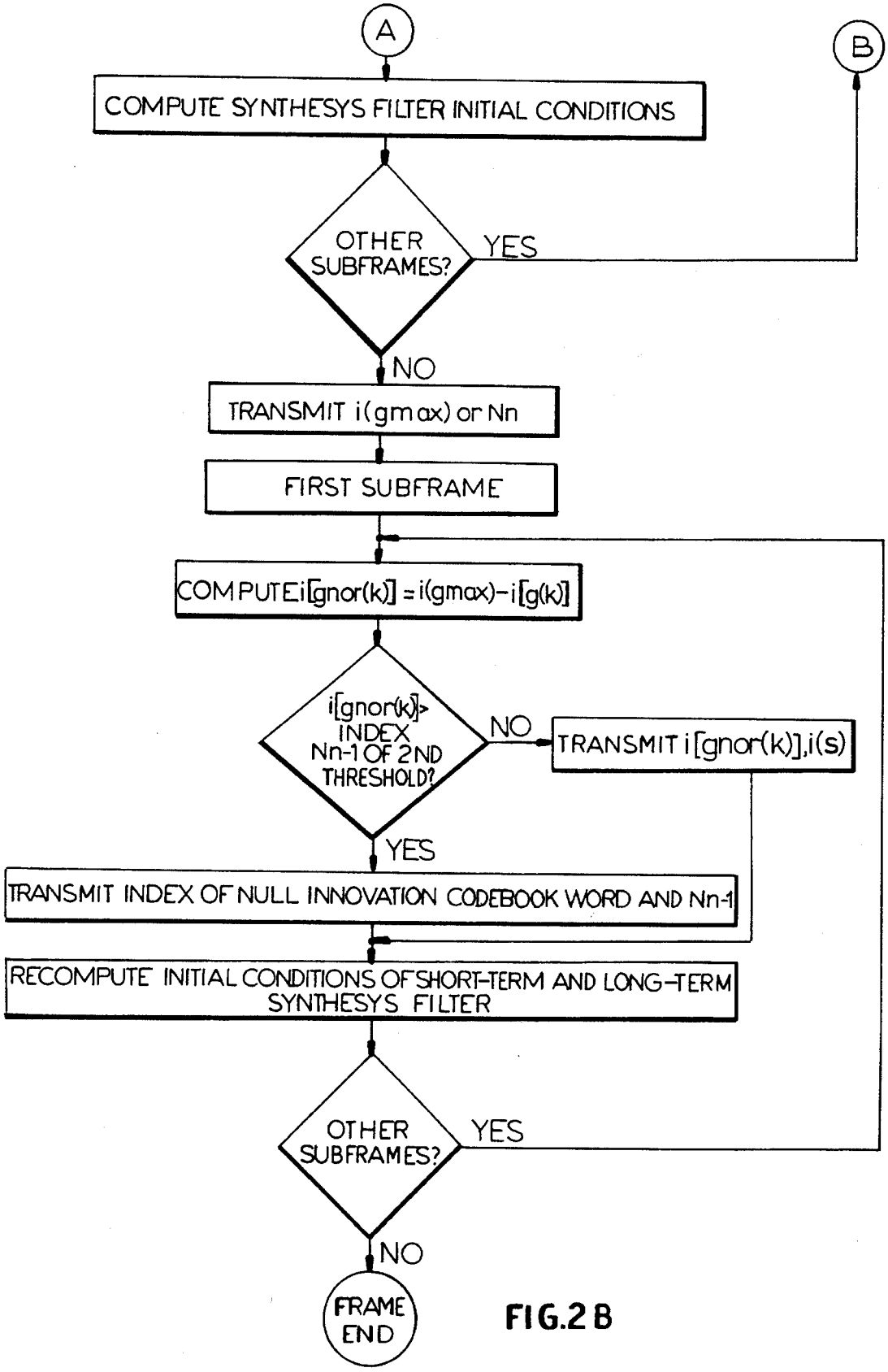

The described operations are also contained in the flow chart in FIGS. 2A, and 2B, which for the sake of clarity and completeness of description shows the whole analysis-by-synthesis procedure during a frame, and not only the gain quantization. In this diagram j is the word index in the innovation codebook and k is the subframe index in the frame.

Preliminary to the operations relevant to the search for optimum excitation in the first subframe the value i(gmax) is set to Nn. The different innovation words are then tested, their gains g(j,k) are calculated and the quantized values of these gains are determined, thus obtaining indexes i[g(j,k)]. Using these quantized values the energy of the weighted error is calculated and indexes i(s), i(g) of pairs innovation word-gain giving the minimum energy are stored.

At the end of the first subframe i(gmax) is updated if i[g(1)]>Nn. By using the quantized value of g the initial conditions of the filters in filter FS1 (FIG. 1) are calculated and then the described operations are repeated for the other subframes. At the end of the frame, the index i(gnor) for each subframe is calculated and for each value the comparison with Nn−1 is carried out, causing transmission of index i(s) corresponding to the null innovation word for the subframes where i(gnor)>Nn−1. At the end of the check on the index i(gnor) of each subframe a new calculation of the initial conditions of the filters in synthesis filter FS1 is effected to take into account, in the following frame, any silencing of the innovation in one or more subframes. This new calculation can, however, be omitted to reduce the complexity of operations, without reducing noticeably the quality of coded signal.

The check on index i(gmax) does not appear in the flow chart. As a matter of fact the check is implicit in the initialization of i(gmax) to the value Nn before the search for the optimum excitation, since in this way this value will be issued as a value of i(gmax) if no indexes i(g)>Nn exist in the frame (see also FIGS. 4A–4D).

Figure 3:
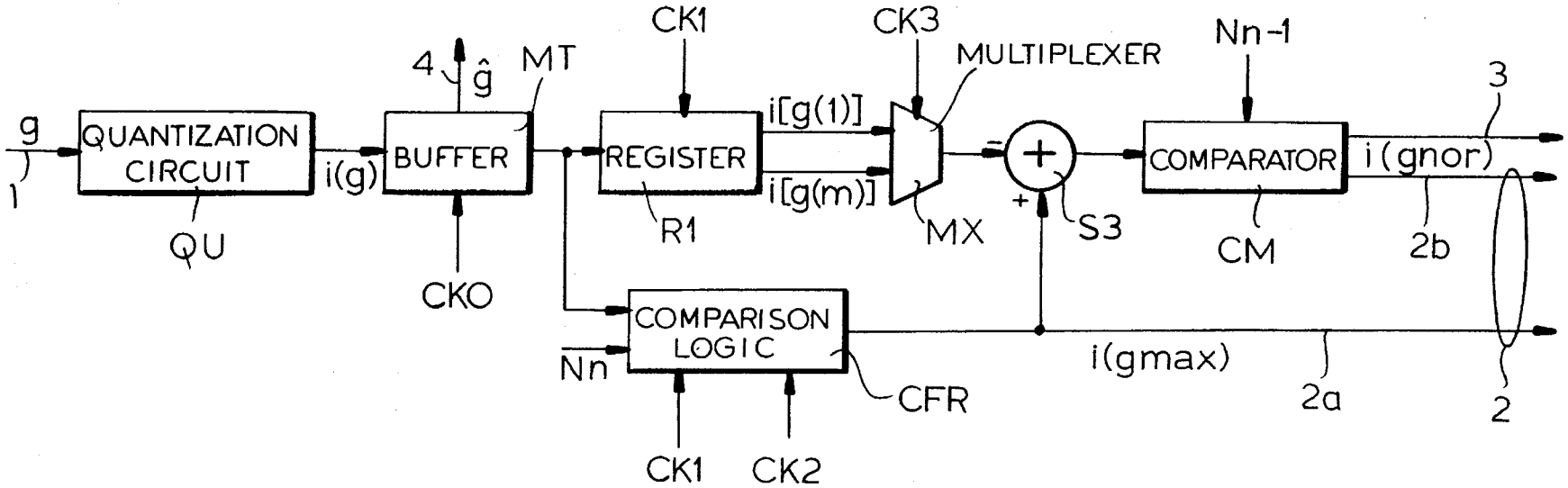
FIG. 3 is a diagram of the gain quantization circuit.
Figure 4A:
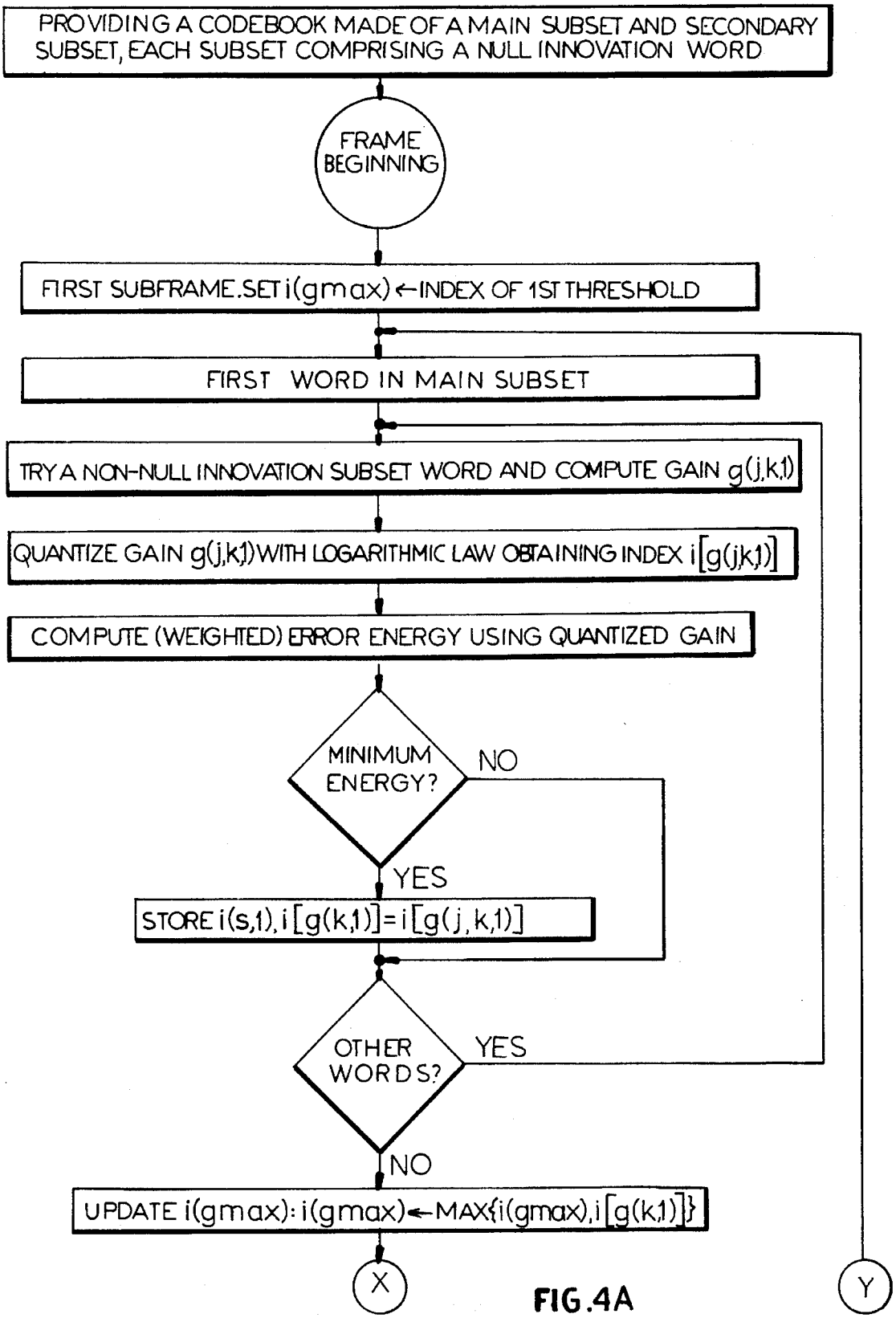
FIGS. 4A–4D are a diagram of the algorithm.
Figure 4B:
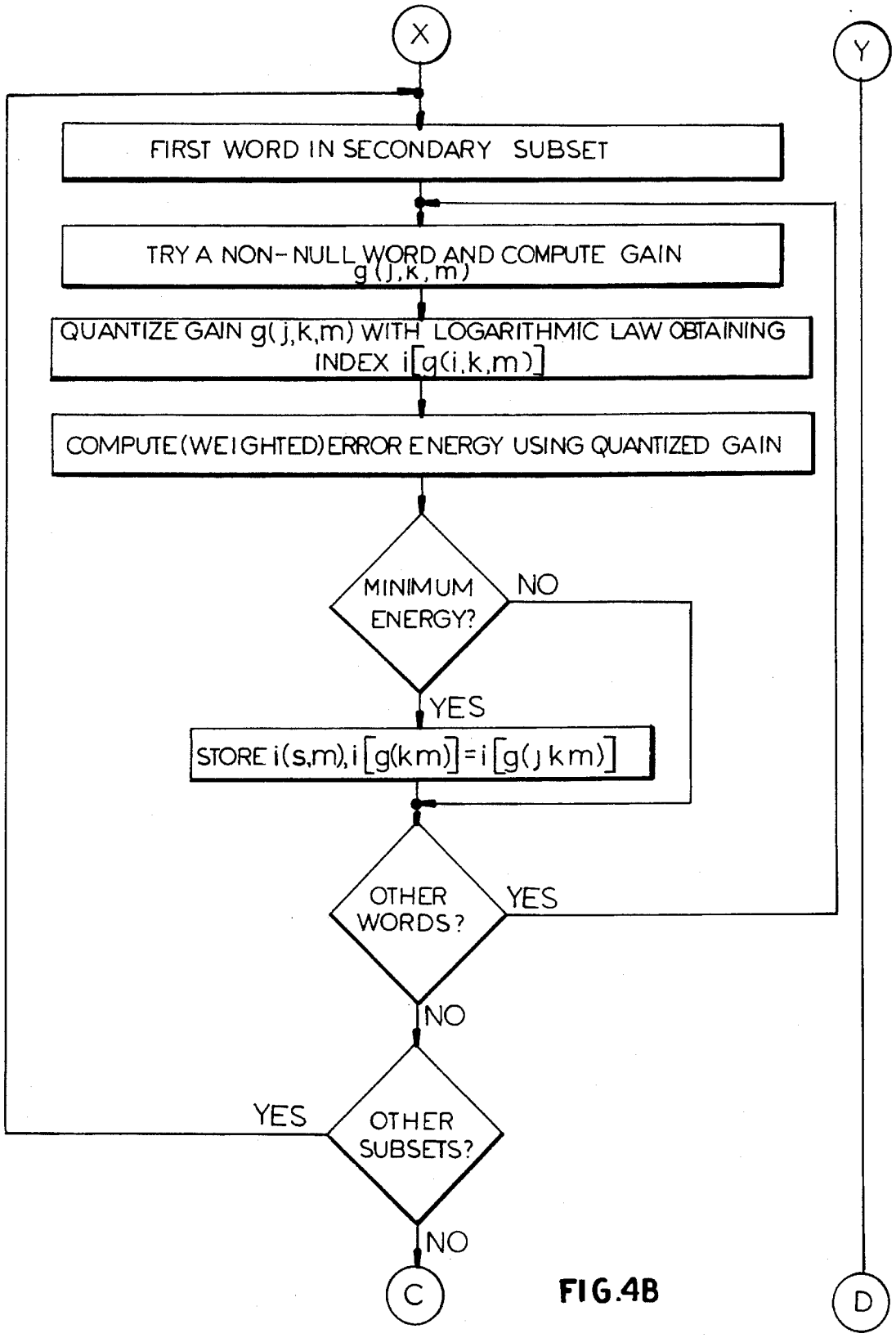
Figure 4C:
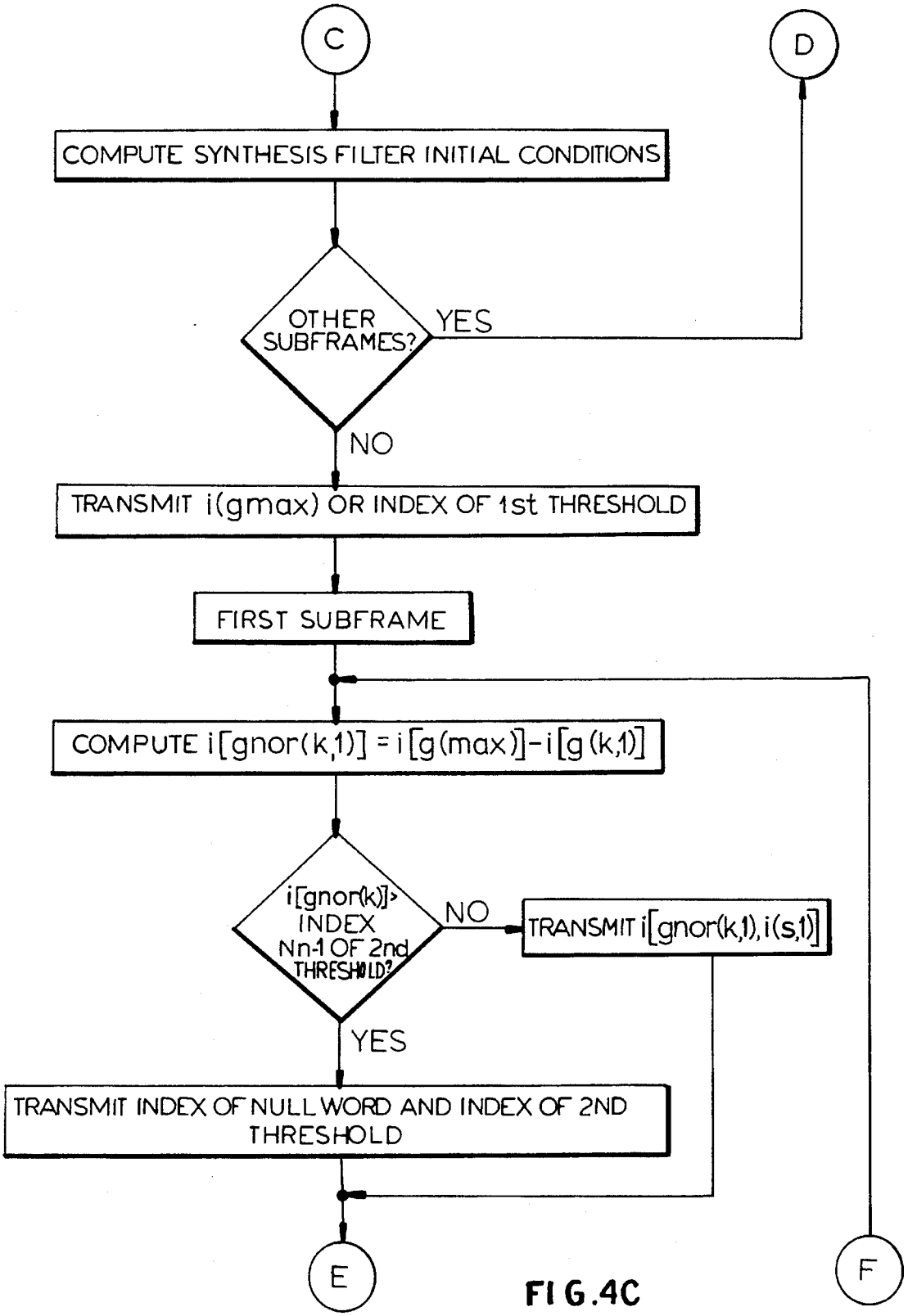
Figure 4D:
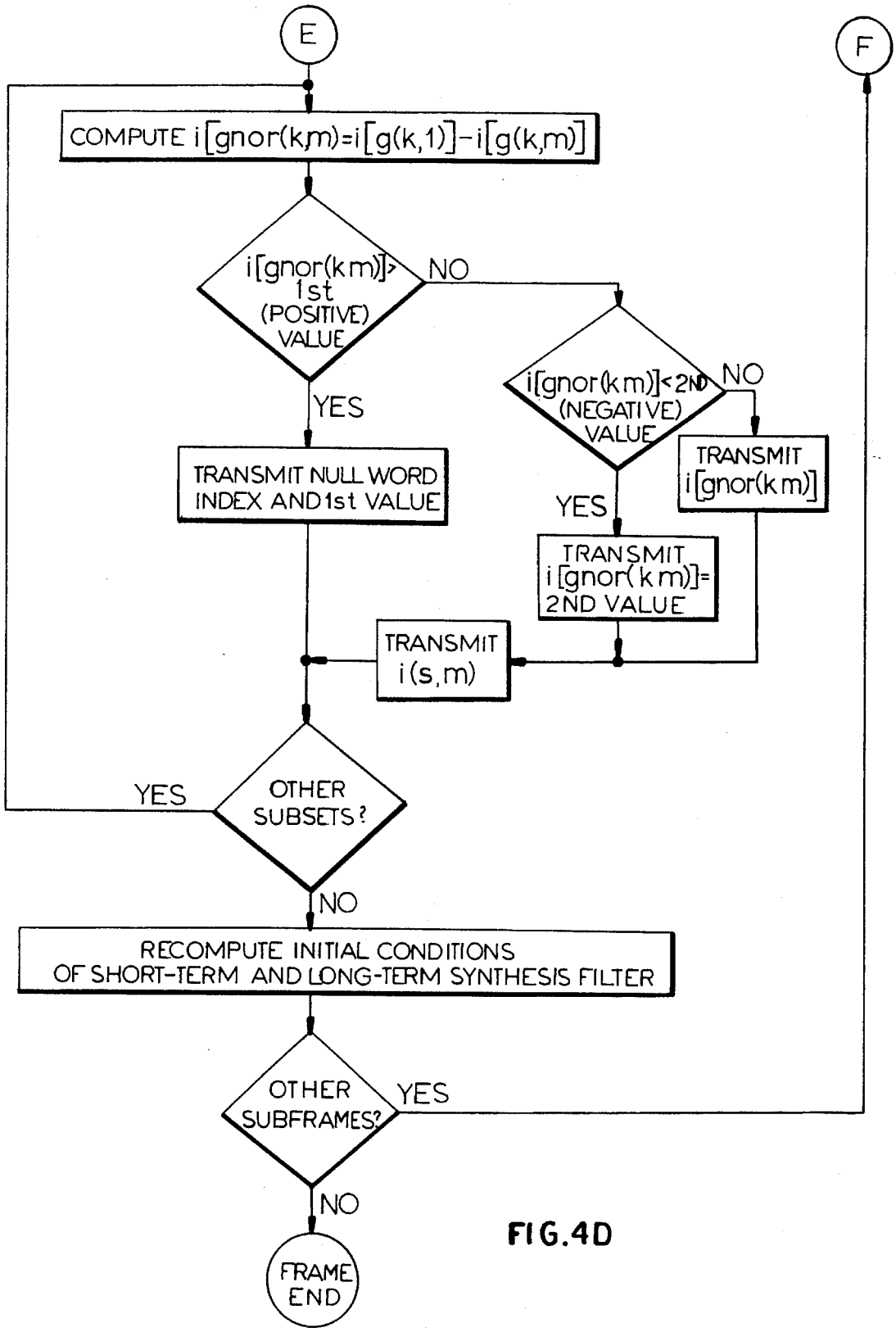

FIG. 3 is a diagram of a possible realization of gain quantization block IT.

This comprises a quantization circuit QU, quantizing, e.g. according to a logarithmic law, the gain values g determined by vector and gain detector EL (FIG. 1) for each innovation word and present on a connection 1. Quantizer QU supplies quantized values g^ to M1 (connection 4) and also generates indexes i(g) which represent the quantized values. Upon command of a signal CK0 emitted by Vector and gain detector EL whenever a minimum of error energy is detected, the index i(g) present at that instant at the output of quantizer QU is loaded in a buffer MT. At the end of the minimization procedure relevant to the subframes in a frame. This index is also loaded, upon command of the same signal CK1, into a comparison logic network CFR, which is able to recognize and to store into an internal register the maximum among the indexes received. In this internal register of comparison logic CFR the minimum value Nn admissible for i(gmax) will have been loaded before the beginning of the frame, so as to effect the above mentioned check. At the end of the frame, the value i(gmax) in the register of CFR (which as noted earlier is one of the comparison logic indexes i(g) or value Nn) is supplied by means of a connection 2*a* to the positive input of an adder S3 and transferred to index coding circuit CD. Reading of i(gmax) takes place upon command of a signal CK2, emitted after loading index i(g) relevant to the last subframe in a frame.

Adder S3 receives in sequence from register R1 the values of indexes i(g) of the current frame by means of multiplexer MX controlled by a signal CK3, and subtracts each of them from i(gmax) giving the normalized values i[gnor(k)]. A comparator CM compares indexes i(gnor) with a second threshold Nn−1 and at each comparison sends to circuit CD, via an output connection 2*b*, the value i(gnor), if it is less than or equal to Nn−1, otherwise it emits value Nn−1. Comparator CM also emits a signal indicating the result of the comparison, sent to EL by means of connection 3 to cause vector and gain detector EL to sent to coder CD the index corresponding to the null word when i(gnor)>Nn−1.

The object of the invention is to allow a good efficiency of the gain coding taking into account, with a high probability, the gain quantization effects in the optimum excitation search and in the computation of the synthesis filter initial conditions. The first aspect also implies that the total number Ng of quantization levels is rather limited.

The gain codebook can be a logarithmic codebook, so that the ratio between two consecutive values is a constant. To design the codebook several requirements must be satisfied:

- values in dB must be as near as possible to allow a quantization as accurate as possible;
- global dynamics between minimum gain g(1) and maximum again g(Nm+Nn−1) must be adequately extended to cover the different types of sound and a reasonable set of different voice levels;
- differential dynamics for indexes i(gnor) must be adequately extended to make the probability of silencing reasonably low.

In practical realization examples good performance was obtained by using codebooks in which Nm was $2^4$ Nn was $2^2$ or $2^3$ and the ratio between consecutive values fell in the range from 3 to 5 dB.

The described method actually eliminates the drawbacks of the known technique.

The transmitting of differential information instead of an absolute information reduces remarkably the number of bits to be dedicated to gain coding, since the admissible dynamics is limited with respect to the overall dynamics provided by the quantization law, as already said in the discussion of EP-A-0396121. Moreover, this approach affords a greater robustness against channel errors since errors in transmission of individual parameters i(gnor) produce level variations which are lower than those obtainable by transmitting an absolute information.

By way of example, with the values given above for Ng, Nm and Nn, 4 bits are necessary for coding i(gmax) and 2 or 3 bits for each i(gnor); the transmission of individual indexes i(g), with the same codebook size and therefore with the same number of indexes, would require 5 bits for each subframe. In practice, the before, the invention is convenient and has no drawback whenever the frame is divided into subframes.

Moreover, with the use of the maximum index and of the differential indexes to represent the gain, in the place of maximum value and of normalized values, the necessity for a double codebook of quantized values is eliminated.

Furthermore, quantized gain values are in any case calculated at each subframe and they can therefore be used in the search for the optimum word for individual subframes: in this way, except for the case of silencing, the optimization of the innovation word is improved since it takes into account quantization effects. The same effect is taken into consideration for initializing the filters at each subframe. In this way the distortion introduced will be reduced if compared to the case in which quantization effects are not taken into consideration.

It should be noted that also the use of a null innovation word could be decided beforehand (i.e. outside the analysis-by-synthesis loop) in order to represent with a perfect silence signal portion the energy of which is below a certain threshold or more generally signal portions for which such representation is deemed to be suitable from the perceptual standpoint (idle channel noise). This solution offers some advantages with respect to having the silencing carried out at the decoder since, in this way, the decoder is not bound to reconstruct the whole frame before effecting the silencing (to be assessed considering at least a complete frame) and it can immediately reproduce any subframe, as soon as it has the necessary information available, thus reducing the overall communication delay. In this case, value Nn is transmitted for i(gmax) and value Nn−1 for all indexes i(gnor), and this corresponds to having an index $\hat{i}(g)=1$ for all subframes: in this way, should an index i(s) corresponding to a non-null word be received by any channel error, the gain would in any case be kept as low as possible.

It is clear that what has been described has been given by way of example. Variations and modifications are possible without going out of the scope of the invention.

So, for example, the invention can be applied to coders where the innovation is supplied by different branches (with their respective gains), such as the coders described by I. A. Gerson and M. A. Iasuk in the paper "Vector Sum Excited Linear Prediction (VSELP) Speech Coding at 8 kbp/s" presented at International Conference on Acoustics, Speech and Signal Processing (ICASSP 90), Albuquerque (US), 3–6 Apr. 1990, or by R. Drogo De Iacovo and D. Sereno in the paper "Embedded CELP coding for variable bit rate between 6, 4 and 9, 6 kbits/s" presented at International Conference on Acoustics, Speech and Signal Processing (ICASSP 91), Toronto (Canada), 14–17 May 1991. For the first branch the gain quantization method remains as that described. For each of the other branches, for each subframe, the normalized index is represented by the difference between gain index i(g) determined for the preceding branch in the same subframe and that of the branch being considered, and only the normalized index is transmitted. In other words, the normalized index for all the branches following the first one is i[gnor(k, m)]=i[g (k, m−1)]−i[g(k, m)], where k still indicates the generic subframe and m ($2 \leqq m \leqq M$, with M number of innovation branches) indicates the generic branch. The dynamics of i(gnor) must be limited also for these branches, considering that i(gnor) can be positive or negative: more particularly, if i(gnor) is positive and exceeds a certain threshold, innovation will be silenced as before; if i(gnor) is too negative, it is clipped to a preset value, e.g. −2, −1 or even 0, so that the innovation component supplied by that branch has a limited amplitude. The limits are obviously chosen so as to have low probabilities both of silencing and of clipping. The advantage as compared to the normalization with respect to i(gmax) also for the branches following the first one is twofold:

the necessity for transmitting M values of i(gmax) is eliminated; and considering that the different components of the same subframe have amplitudes quite correlated to one another, and particularly that it is rather unlikely that there could be strong differences between subsequent components, indexes i(gnor) for the branches following the first one will each require very few bits.

Finally, the invention can be applied to the quantization of the excitation gain in any analysis-by-synthesis coder.

One more statement is that in the more general case gains can have a positive or a negative sign.. The invention however concerns absolute value quantization: information about the sign, if necessary, will be supplied to coder CD by vector and gain detector EL (FIG. 1) and transmitted through a special bit.

We claim:

1. A method of quantizing excitation amplitude in speech coders based on analysis-by-synthesis techniques, comprising the steps of:

(a) organizing samples of speech signal to be coded into frames each comprising a plurality of contiguous subframes for each of which subframes an optimum excitation signal must be determined by minimizing a perceptually meaningful measure of distortion, said excitation signal comprising a first contribution, representing a signal shape, and a second contribution, representing a signal amplitude, both contributions being chosen in respective sets within which each possible contribution is identified by an innovation index i and a gain index i;

(b) during coding, quantizing a signal amplitude constructing said second contribution of a respective excitation signal for each subframe, thereby determining a corresponding value of said gain index i(g) representing the signal amplitude constituting said second contribution;

(c) determining a maximum index i(gmax) of said gain index i(g) in a frame;

(d) calculating a normalized index i(gnor) relevant to each subframe as a difference between said maximum index i(gmax) and a respective subframe gain index i(g);

(e) coding a maximum index i(gmax) and a set of normalized index i(gnor) are coded and transmitted; and (f) during decoding, reconstructing the gain index i(g) of each subframe from a maximum index i(gmax) in the frame and from normalized index i(gnor) relevant to the subframe.

2. The method defined in claim 1 wherein said maximum index and all normalized indexes identify quantized amplitude values inside a common set.

3. The method defined in claim 2 wherein the maximum index in a frame i(gmax) identifies a quantized amplitude value lower than a first threshold, a gain index associated with the said first threshold is used for determining normalized index i(gnor) and is coded and transmitted.

4. The method defined in claim 2 wherein the set of the shape contributions comprises also a null contribution, and when a normalized index i(gnor) in a subframe identifies a quantized amplitude value higher than a second threshold, information is transmitted by means of an innovation index corresponding to a null shape contribution, so as to silence an excitation for the respective subframe.

5. The method defined in claim 4 wherein an index associated to said second threshold is coded and transmitted as a normalized index.

6. The method defined in claim 4 wherein the excitation is silenced for at least one of said frames by transmitting, for all subframes, the innovation index corresponding to a null shape contribution, for signal reproduction by means of a period of silence.

7. The method defined in claim 4 wherein values corresponding to the said first and second thresholds are transmitted as indexed i(gmax) and i(gnor).

8. The method defined in claim 1 wherein said excitation signal for a subframe is obtained as a combination of excitations chosen in separate subsets, comprising a main subset and one or more secondary subsets, and amplitude contribution representing the signal amplitude constituting said second contribution is quantized for said main subset by using said maximum index i(max) and said normalized indexes i(gnor), for each secondary subset the amplitude contribution being quantized solely by means of a group of differential indexes, one per subframe, each differential index being obtained by subtracting a gain index of a respective secondary subset from a gain index determined for the same subframe for the previous secondary subset in step (d).

9. The method defined in claim 8 wherein for each differential index higher than a first preset positive value, the corresponding excitation shape contribution is silenced, and for each differential index lower than a second preset value, the differential index is given a value which is not lower than the second preset value.

10. The method defined in claim 1 wherein the amplitude contribution is quantized according to a logarithmic quantization law.

11. A device for quantizing excitation amplitude in speed coders based on analysis-by-synthesis techniques, in which samples of the speech signal to be coded are divided into frames each comprising a plurality of contiguous subframes for each of which an optimum excitation signal is determined by minimizing a perceptually meaningful measure of distortion, said excitation signal comprising a first contribution representing a signal shape, and a second contribution representing a signal amplitude, both contributions being chosen in respective sets within which each possible contribution is identified by an innovation index i and a gain index i, respectively, said device comprising a transmission side and a reception side, said transmission side comprising:

means for quantizing amplitude contribution values determined by a distortion minimization unit for each possible shape contribution, the quantizing means supplying quantized amplitude values and gain indexes representing said amplitude values;

a comparison logic network which receives from the quantization means, at each subframe, a gain index i(g) identifying the optimum amplitude contribution for a particular subframe, said comparison logic network being arranged to recognize and to supply to an index coding unit, at the end of a frame, a maximum index i(gmax) among the received gain indexes;

storage means for temporary storing the gain index i(g) each of said frames, thereby accumulating stores gain indexes;

means for computing a set of normalized indexes i(gnor), one per subframe, the computing means receiving from the comparison logic network the maximum index and from the storage means the stored gain indexes, and for computing said set of normalized indexes are the difference between maximum index i(gmax) and each of the stored indexes i(g) in said storage means, the normalized indexes being supplied to said index coding unit (CD);

said reception side comprising means for constructing a gain index i(g) for each subframe starting from the maximum index and from the normalized indexes, decoded in a decoding circuit, and means for supplying the gain index i(g) as a reading address to a memory containing the quantized amplitude values.

12. The device defined in claim 11 wherein said quantizing means is a quantizing circuit which quantizes the amplitude contribution values according to a logarithmic scale.

13. The device defined in claim 11 wherein said comparison logic network stores, at the beginning of each frame, an initial value for the maximum index i(gmax), said initial value being a first threshold value representing a minimum admissible value for the maximum index i(gmax).

14. The device defined in claim 11 wherein the means for computing a set of normalized indexes supplies said normalized indexes to a comparison means which compares each normalized index with a second threshold value and supplies an output, at each comparison, either a normalized index or a second threshold value, depending on which is the greatest.

15. The device defined in claim 14 wherein the comparison means, whenever a normalized index exceeds said second threshold value, signals an excess to a minimization unit, to silence a corresponding shape contribution of the excitation signal by transmitting an innovation index corresponding to a null shape contribution.

* * * * *